US007302822B1

(12) United States Patent
Turnbull et al.

(10) Patent No.: US 7,302,822 B1
(45) Date of Patent: Dec. 4, 2007

(54) SHELL PRESS AND METHOD FOR FORMING A SHELL

(75) Inventors: Robert Dean Turnbull, Massillon, OH (US); Donna Rebecca Stefansic, North Canton, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 0 days.

(21) Appl. No.: 11/448,211

(22) Filed: Jun. 7, 2006

(51) Int. Cl.
*B21D 22/10* (2006.01)

(52) U.S. Cl. ..... 72/348; 72/351; 72/342.3

(58) Field of Classification Search ..... 72/348, 72/349, 379.4, 351, 336, 342.3, 342.4; 413/8, 413/62, 56

See application file for complete search history.

(56) References Cited

U.S. PATENT DOCUMENTS

| | | | | |
|---|---|---|---|---|
| 4,587,825 | A | 5/1986 | Bulso, Jr. et al. | |
| 4,713,958 | A | 12/1987 | Bulso, Jr. et al. | |
| 4,715,208 | A | 12/1987 | Bulso, Jr. et al. | |
| 4,716,755 | A | 1/1988 | Bulso, Jr. et al. | |
| 4,808,052 | A | 2/1989 | Bulso, Jr. et al. | |
| 4,865,506 | A * | 9/1989 | Kaminski | 413/56 |
| 4,903,521 | A | 2/1990 | Bulso, Jr. et al. | |
| 4,955,223 | A | 9/1990 | Stodd et al. | |
| 4,977,772 | A | 12/1990 | Bulso, Jr. et al. | |
| 5,042,284 | A | 8/1991 | Stodd et al. | |
| 5,046,637 | A * | 9/1991 | Kysh | 220/610 |
| 5,309,749 | A | 5/1994 | Stodd | |
| 5,491,995 | A | 2/1996 | Stodd | |
| 5,502,995 | A | 4/1996 | Stodd | |
| 5,634,366 | A | 6/1997 | Stodd | |
| 5,669,259 | A | 9/1997 | Stodd | |
| 5,857,374 | A | 1/1999 | Stodd | |
| 5,901,598 | A * | 5/1999 | Haar | 72/345 |
| 6,658,911 | B2 | 12/2003 | McClung | |
| 6,968,724 | B2 | 11/2005 | Hubball | |
| 2005/0044921 | A1 * | 3/2005 | McClung | 72/348 |

* cited by examiner

*Primary Examiner*—Derris H. Banks
*Assistant Examiner*—Debra M Wolfe
(74) *Attorney, Agent, or Firm*—David P. Maivald; Eckert Seamans Cherin & Mellott, LLC

(57) ABSTRACT

An apparatus and method for forming a shell with a central panel and a chuck wall is provided. The apparatus and method employ the use of a biasing member to selectively bias and control movement of the inner pressure sleeve and a die core having an outer diameter equal to or greater than the outer diameter of the punch core. The apparatus and method can also be employed in a single action press or a double action press.

20 Claims, 8 Drawing Sheets

SHELL PRESS AND METHOD FOR FORMING A SHELL

FIELD OF THE INVENTION

The invention generally relates to an apparatus and method for forming container end panels, commonly called shells, from a sheet of blanked material. More particularly, the invention relates to a press and method for forming the shell with the press having a biasing member that selectively biases and controls movement of the inner pressure sleeve and a die core having an outer diameter equal to or greater than the outer diameter of the punch core.

BACKGROUND OF THE INVENTION

The forming of can ends or shells for can bodies, namely aluminum or steel cans, is well-known in the art. Shells typically have a central panel connected to an inner panel wall which is connected to a countersink. The countersink is usually connected to a chuck wall of the shell which is connected to a peripheral curl that is structured to be seamed onto a can body.

A representative patent disclosing shell forming is Bulso U.S. Pat. No. 4,716,755. As is typically seen, the inner pressure sleeve of a shell press is mounted around a punch core. See, e.g., element 13 of FIG. 1 in Bulso U.S. Pat. No. 4,716,755. Alternatively, the inner pressure sleeve is supported on a column of gas (See, e.g., element 40 of FIG. 2 in McClung U.S. Pat. No. 6,658,911) or the inner pressure sleeve is supported on a piston. These approaches are not without certain limitations though.

The inner pressure sleeve mounted around a punch core, supported on a column of gas or supported on a piston can lead to the inner pressure sleeve heating up excessively in the shell forming process due to the loads that are applied to the inner pressure sleeve from formation of the chuck wall area of the shell being formed. Excess heat generation in the inner pressure sleeve is not desirable in shell forming since the inner pressure sleeve can undergo thermal expansion and cause the press to form shells that do not meet the tolerances required by a can maker.

Also, the inner pressure sleeve mounted around a punch core, supported on a column of gas or supported on a piston can cause excessive strain hardening to occur in the chuck wall area of the shell being formed. Excess strain hardening of the chuck wall is not desirable in shell forming since the final converted can end could crack or deform once the can end is seamed onto a can body containing product that is under pressure.

Due to the potentially high internal pressures generated by carbonated beverages, both the can body and the can end are typically required to sustain internal pressures of 90 psi (0.621 MPa) without cracking or deformation. Depending on various environmental conditions such as heat, over fill, high carbon dioxide content, and vibration, the internal pressure in a beverage may exceed internal pressures of 90 psi (0.621 MPa). Recently, shell developments have been focused on engineering various features of the shell including the chuck wall angle in order to reduce the metal content in the shell and allow the shell to sustain internal pressures exceeding 90 psi (0.621 MPa). Steering away from excess strain hardening of the chuck wall is desirable to avoid catastrophic and permanent deformation of the converted can end.

Another representative patent disclosing shell forming is Hubball U.S. Pat. No. 6,968,724. Huball uses a die core and a punch core with the die core having an outer diameter less than the outer diameter of the punch core. This approach is not without certain limitations though.

The portion adjacent to a surface of the die core in Hubball is not in contact with the die core ring located proximate to the die core. Hubball's approach does not provide the portion adjacent to the surface of the die core with the control, precision and stability one would obtain by having the portion adjacent to the surface of the die core in contact with the die core ring located around the die core.

A need exists in the art for an apparatus and method for forming shells that avoids excessive heat generation in the inner pressure sleeve and selectively biases and controls movement of the inner pressure sleeve to avoid excessive strain hardening of the chuck wall of the shell being formed.

A need also exists in the art for an apparatus and method for forming shells that has a die core with an outer diameter equal to or greater than the outer diameter of the punch core with the portion adjacent to the surface of the die core in contact with the die core ring to provide the die core with greater control, precision and stability.

SUMMARY OF THE INVENTION

An object of the invention is to provide an apparatus and method for forming a shell that avoids excessive heat generation in the inner pressure sleeve and selectively biases and controls movement of the inner pressure sleeve to avoid excessive strain hardening of the chuck wall of the shell being formed.

Another object of the invention is to provide an apparatus and method for forming a shell that provides the portion adjacent to the surface of the die core with greater control, precision and stability.

Certain objects of the invention are achieved by providing an apparatus for forming a shell having a central panel and a chuck wall. The apparatus has a punch core and an inner pressure sleeve located proximate to the punch core and radially outward from the punch core. An outer pressure sleeve is located proximate to the inner pressure sleeve and radially outward from the inner pressure sleeve. A punch shell is located proximate to the outer pressure sleeve and radially outward from the outer pressure sleeve. A die core is located in opposed relation to the punch core. A die core ring is located proximate to the die core and radially outward from the die core in opposed relation to the inner pressure sleeve and the outer pressure sleeve. A pressure pad is located proximate to the die core ring and radially outward from the die core ring in opposed relation to the punch shell. A blank cutedge located proximate to the pressure pad and radially outward from the pressure pad. A biasing member is coupled to the inner pressure sleeve with the biasing member being structured to selectively bias and control movement of the pressure sleeve.

Other objects of the invention are achieved by providing a method for forming a shell having a central panel and a chuck wall. The method comprises: moving material between a first die set and a second die set; blanking the material to form a blank; forming the blank into a shell with the central panel and the chuck wall; and selectively controlling movement of an inner pressure sleeve by biasing the movement of the inner pressure sleeve.

Other objects of the invention are achieved by providing a method for forming a shell having a central panel and a chuck wall. The method comprises the following steps. Material is moved between a first die set and a second die set. The first die set includes a punch core, an inner pressure sleeve located radially outward to the punch core, an outer pressure sleeve located radially outward to the inner pressure sleeve and a punch shell located radially outward to the outer pressure sleeve. The second die set includes a die core located in opposed relation to the punch core, a die core ring located radially outward to the die core in opposed relation to the inner pressure sleeve and the outer pressure sleeve, a pressure pad located radially outward to the die core ring and a blank cutedge located radially outward to the pressure pad. The material is blanked with the punch shell against the blank cutedge to form a blank. The blank is formed into a shell with the central panel and the chuck wall from the material disposed between the punch core, the inner pressure sleeve, the outer pressure sleeve, the die core and the die core ring. Movement of the inner pressure sleeve is selectively controlled by biasing the movement of the inner pressure sleeve.

DESCRIPTION OF THE PREFERRED EMBODIMENTS

Figure 1:
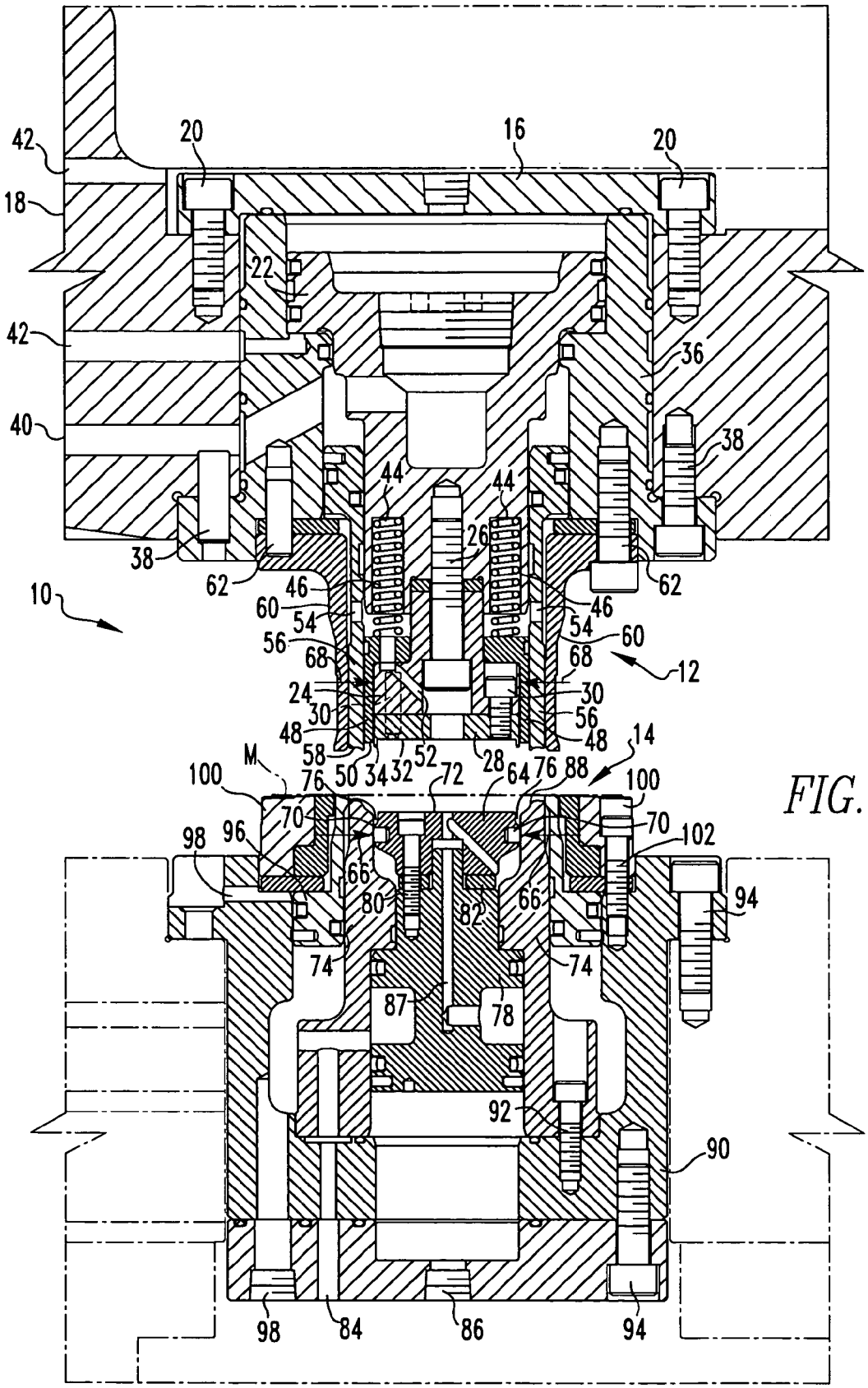
FIG. 1 is cross-sectional view of a shell press assembly shown in an open position.

For purposes of the description hereinafter, the terms "upper", "lower", "vertical", "horizontal", "top", "bottom", "aft", "behind", and derivatives thereof shall relate to the invention, as it is oriented in the drawing FIGS. However, it is to be understood that the invention may assume various alternative configurations except where expressly specified to the contrary. It is also to be understood that the specific elements illustrated in the FIGS. and described in the following specification are simply exemplary embodiments of the invention. Therefore, specific dimensions, orientations and other physical characteristics related to the embodiments disclosed herein are not to be considered limiting.

As employed herein, the term "fastener" refers to any suitable fastening, connecting or tightening mechanism by way of example and not limitation, dowel pins, fasteners, rivets and the like. As employed herein, the statement that two or more parts are "coupled" together shall mean that the parts are joined together either directly or joined together indirectly through one or more intermediate parts.

Turning to FIG. 1, one embodiment of the invention, a single action shell press assembly 10, is shown. Material M is fed into the shell press assembly 10 to form a shell from the material M. It should be understood that shell press assembly 10 may be one of multiple shell press assemblies coupled within a single machine. 12, 24 or any number of shell press assemblies may be coupled within a large housing that contains the structure of the shell press machine, wherein a ram of the machine is movable or rams of the machine (not shown) are movable up and down in an axial direction relative to the stationary housing of the shell press machine.

Shell press assembly 10 generally includes two sections, a first die set 12 and a second die set 14. Material M is generally formed between the first die set 12 and the second die set 14, which carry the wear tooling for the formation of a shell.

The first die set 12 includes a punch cap 16 coupled to a ram 18 with fasteners 20 enclosing a first elongated shaft 22 on which a punch core 24 is coupled with a fastener 26. A nose 28 may be coupled to the punch core 24 with fasteners 30 which has a preselected geometry that is used to form the top portion of the central panel, inner panel wall and countersink of the shell. The nose 28 may have a flat surface 32 which is structured to form the central panel of the shell. The flat surface 32 of the nose 28 may be coupled to a rounded annular projection 34 which is structured to form the countersink of the shell. Alternatively, the nose 28 may be an integral component of punch core 24. As used herein, punch core 24 will be understood as referring to punch core 24 without a nose 28 coupled thereto, with a separate nose 28 coupled thereto or with a nose integrally coupled thereto. Punch cap 16 is, in turn, coupled to a punch cap cylinder 36. Cylinder 36 is coupled to the ram 18 with fasteners 38.

Cylinder 36 defines a cavity for receiving the first elongated shaft 22. Gas may be supplied to and from bores 40, 42 for controlling movement of the first elongated shaft 22, the punch core 24 and an inner pressure sleeve 48. The first elongated shaft 22 is movable in an axial direction to urge punch core 24 in a downward and upward motion and, by extension, can urge a punch core 24 toward to and away from the second die set 14.

The first elongated shaft 22 contains one or more recesses 44 that contain one or more biasing members 46. The biasing members 46 could be, by way of example and not limitation, cushions, elastomeric members, metallic members, plastic members, resilient members, springs and the like. Biasing members expressly does not include a column of gas or a piston. Coupled to the one or more biasing members 46 is the inner pressure sleeve 48 wherein the biasing members 46 selectively bias and control movement of the inner pressure sleeve 48. The inner pressure sleeve 48 is concentrically disposed around the punch core 24, located proximate to the punch core 24 and located radially outwardly from the punch core 24. In the displayed embodiment, the inner pressure sleeve 48 is shown as having a flattened surface 50. As can be appreciated, the surface 50 of the inner pressure sleeve 48 could have a sloped surface or a complementary shape to a tool located opposite to the inner pressure sleeve 48 in the second die set 14. Gas may be supplied to and from bores 52, 54 for removing heat from the inner pressure sleeve 48 or ejecting a formed shell. The inner pressure sleeve 48 heats up in the shell forming process due to the loads that are applied to the inner pressure sleeve 48 from formation of the chuck wall area in the shell. Excess heat generation in the inner pressure sleeve 48 is not desirable in shell forming since the inner pressure sleeve 48 can undergo thermal expansion and cause the shell press assembly 10 to form shells that do not meet the tolerances required by a can maker. Gas supplied to and from bores 52, 54 advantageously removes heat from the inner pressure sleeve 48.

An outer pressure sleeve 56 is concentrically disposed around the inner pressure sleeve 48, located proximate to the inner pressure sleeve 48 and located radially outwardly from the inner pressure sleeve 48. In the displayed embodiment, the outer pressure sleeve 56 is shown as having a curved or rounded surface 58. Gas may be supplied to and from bore 40 for controlling movement of the outer pressure sleeve 56.

A punch shell 60 is concentrically disposed around the outer pressure sleeve 56, located proximate to the outer pressure sleeve 56 and located radially outward from the outer pressure sleeve 56. The punch shell 60 is coupled to the punch cap cylinder 36 with fasteners 62. The first die set 12 can be axially raised away and lowered toward the second die set 14 by selectively actuating the ram 18.

The second die set 14 includes a die core 64 located in opposed relation to the punch core 24 which cooperate to form the central panel, inner panel wall and countersink of the shell. As can be seen, the die core 64 has an outer diameter 66 that is equal to or greater than an outer diameter 68 of the punch core 24 such that the portion 70 proximate to the flat surface 72 of the die core 64 is in contact with a die core ring 74 concentrically disposed around the die core 64. The die core ring 74 is located proximate to the die core 64 and located radially outward from the die core 64. Die core ring 74 is located in opposed relation to the inner pressure sleeve 48 and the outer pressure sleeve 56 which cooperate to form the chuck wall and the peripheral curl of the shell. With portion 70 in contact with the die core 64, greater control, precision and stability is provided to the die core 64. The flat surface 72 of the die core 64 transitions to an annular recess 76 which is located proximate to portion 70 having the maximum outer diameter 66 of the die core 64. Annular recess 76 is sized or structured to receive the countersink of the shell being formed by annular projection 34 and annular recess 76.

Figure 2:
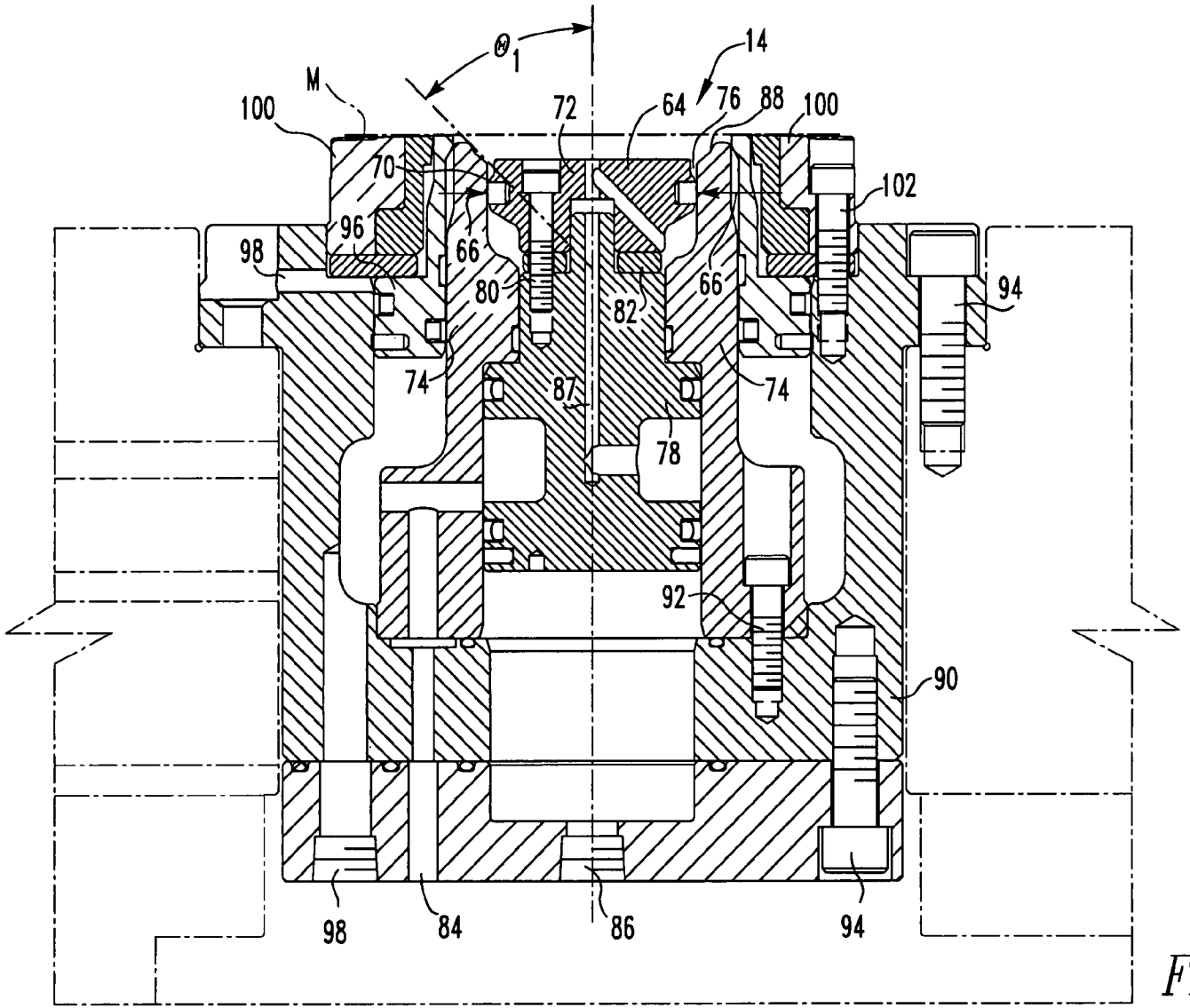
FIG. 2 is a cross-sectional view of a shell press assembly showing the angle, $\theta_1$ of the die core ring.

Die core 64 is coupled to a second elongated shaft 78 with a fastener 80. A resilient member 82 is located between the die core 64 and the second elongated shaft 78 for cushioning the load applied to the die core 64 during shell forming. Resilient member 82 may also be a shim for adjusting the die core 64. Resilient member 82 could be, by way of example and not limitation, cushions, elastomeric members, metallic members, plastic members, springs and the like. Gas may be supplied to and from bores 84, 86 for controlling movement of the second elongated shaft 78 and the die core 64. Gas may be supplied to bore 87 for ejecting the shell after it has been formed. Alternatively, a lift out ring (not shown) may be provided in the second die set 14 for ejecting the shell after it has been formed. The die core ring 74 has a preselected geometry for surface 88 which is structured to form the chuck wall of the shell in cooperation with the inner pressure sleeve 48. If a line is drawn from one point on the die core ring 74 that is structured to form the lower portion of the chuck wall to a second point on the die core ring 74 that is structured to form the upper portion of the chuck wall, the angle, $\theta_1$ of the line relative to a vertical axis may be anywhere between approximately 20 degrees to approximately 60 degrees. See, FIG. 2. The die core ring 74 is coupled to a die core cylinder 90 with a fastener 92. Die core cylinder 90 is coupled to the second die set 14 with fasteners 94.

A pressure pad 96 is concentrically disposed around the die core ring 74, located proximate to the die core ring 74 and located radially outwardly from the die core ring 74. The pressure pad 96 is located in opposed relation to the punch shell 60 and supports the punch shell 60 in shell forming. Gas may be supplied to and from bores 98 for controlling movement of the pressure pad 96 or for removing heat or for venting.

A blank cutedge 100 is located proximate to the die core ring 74 and located radially outwardly from the die core ring 74. The blank cutedge 100 is structured to cooperate with the punch shell 60 in blanking material M such as, for example, aluminum and steel alloyed sheet. The blank cutedge 100 is coupled to the second die set 14 with a fastener 102.

Referring to FIGS. 1 and 3-7, the operation of the apparatus and method of the invention will be described. In FIG. 1, material M has been inserted into the shell press assembly 10, either in sheet form or from a coil of material M, and is moved between the first die set 12 and the second die set 14. The first die set 12 contains at least four tools from radially inward to radially outward: punch core 24, inner pressure sleeve 48 concentrically disposed around the punch core 24, outer pressure sleeve 56 concentrically disposed around the inner pressure sleeve 48 and punch shell 60 concentrically disposed around the outer pressure sleeve 56. These tools can be manipulated in an upward and downward motion by the ram 18. While the exemplary FIGS. only show one ram 18 in a single action press, one of skill in the art would appreciate that the teachings of the invention could be used in a double action press (not shown) that has two movable rams in addition to the single action press shown in the FIGS. The invention disclosed in this patent application is applicable to single action presses and double action presses. The first elongated shaft 22 may also be axially actuated by supplying gas to and from bores 40, 42 which would cause corresponding axial movement in the punch core 24 and the inner pressure sleeve 48 coupled to the first elongated shaft 22. The outer pressure sleeve may also be axially actuated by supplying gas to and from bore 40.

The second die set 14 contains at least four tools, from radially inward to outward: die core 64 with annular recess 76, die core ring 74 concentrically disposed around the die core 64, pressure pad 96 concentrically disposed around the die core ring 74, and blank cutedge 100 located proximate to the pressure pad 96. The die core 64 may be axially actuated upward and downward by supplying gas to and from bores 84, 86. Die core ring 74 is not movable. Pressure pad 96 may be axially actuated upward and downward by supplying gas to and from bores 98.

Figure 3:
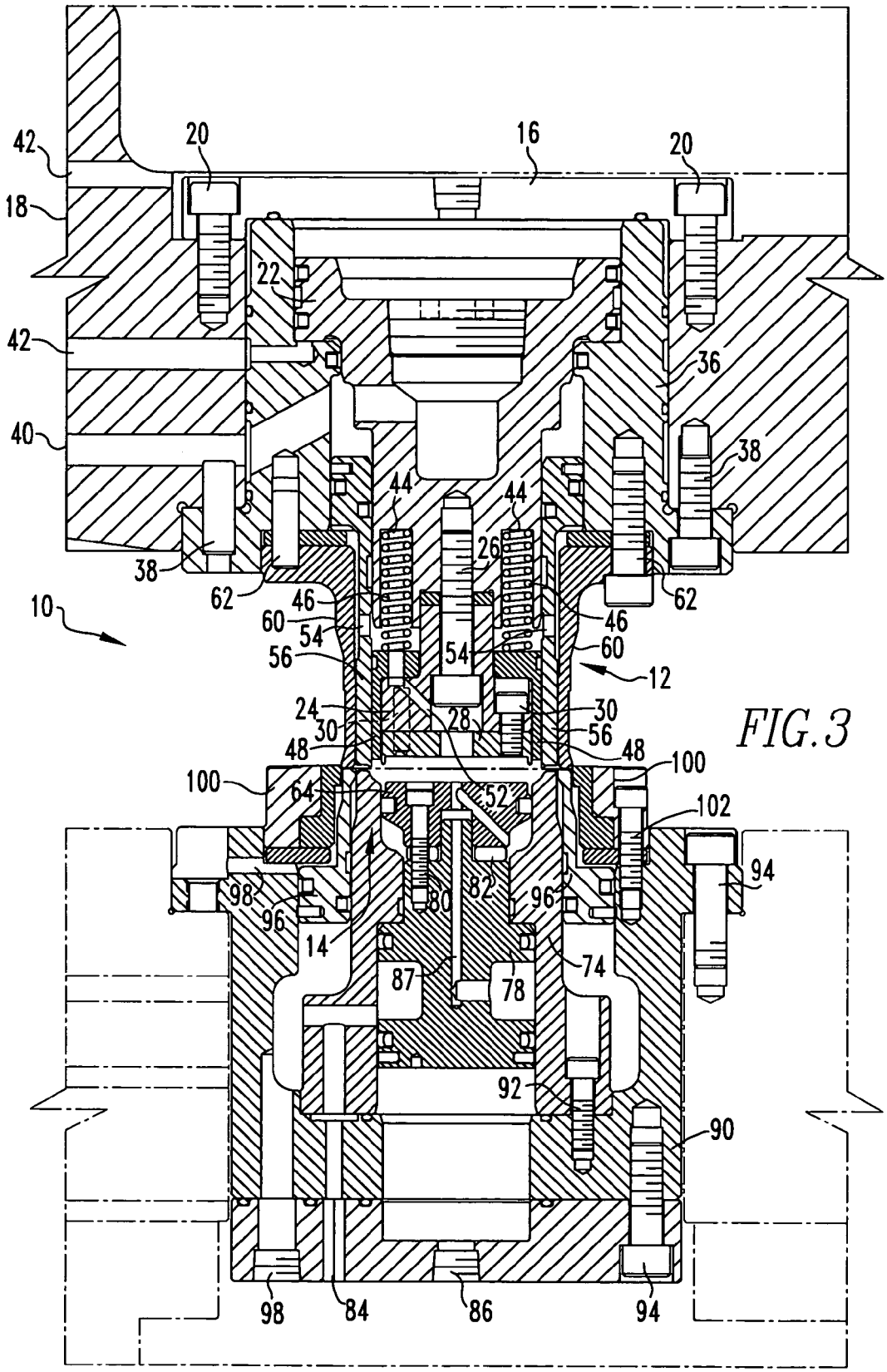
FIG. 3 is a cross-sectional view of a shell press assembly blanking material.

In FIG. 3, the ram 18 begins its descent towards the second die set 14 and the punch shell 60 blanks the material M against the blank cutedge 100 to form a blank. The punch shell 60 pushes the pressure pad 96 downward and a column of gas continues to support the pressure pad 96.

Figure 4:
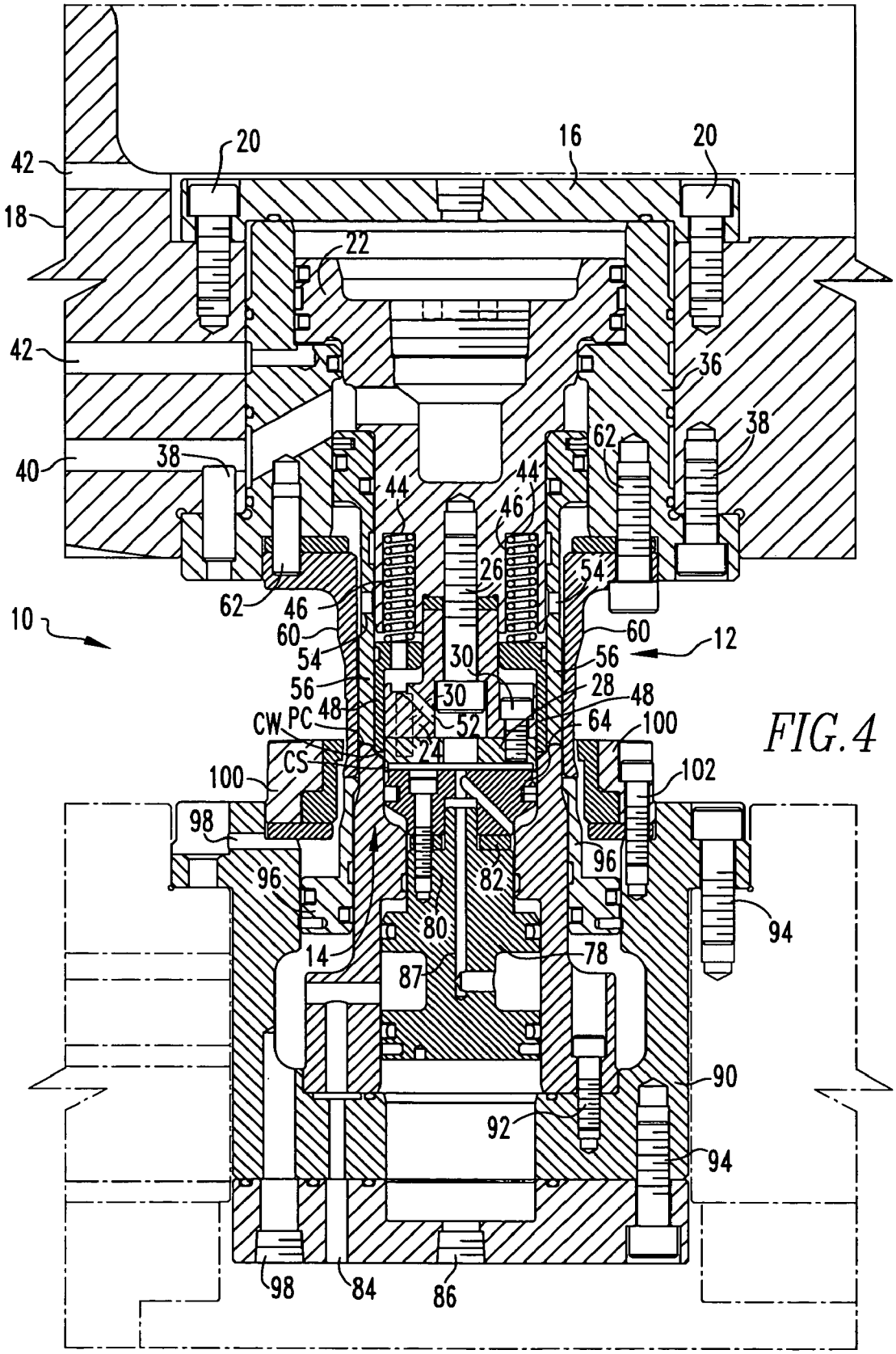
FIG. 4 is a cross-sectional view of a shell press assembly at the bottom stroke of the press.

In FIG. 4, the ram 18 reaches the bottom of the stroke and the punch shell 60 wipes the material M over the die core ring 74 to preliminarily form the peripheral curl PC of the shell between the outer pressure sleeve 56 and the die core ring 74. The punch shell 60 continues to push the pressure pad 96 downward and a column of gas continues to support the pressure pad 96. Bottoming of the ram 18 pushes the outer pressure sleeve 56 upward and a column of gas continues to support the outer pressure sleeve 56. The outer pressure sleeve 56 and the die core ring 74 continue to hold the material M of the shell. Also, the chuck wall CW of the shell is preliminarily formed between the inner pressure sleeve 48 and the die core ring 74. The die core ring 74 has a preselected geometry for the surface 88 in order to form the desired chuck wall CW profile on the shell.

The load applied to the inner pressure sleeve 48 selectively biases biasing members 46 upward and selectively controls movement of the inner pressure sleeve 48 upward in order to avoid excessive strain hardening of the chuck wall CW of the shell being formed. Excess strain hardening of the chuck wall CW is not desirable in shell forming since the final converted can end could crack or deform once the can end is seamed onto a can body containing product that is under pressure. The invention solves the problem of excessive strain hardening of the chuck wall CW that is experienced in other shell forming systems.

Also, the load applied to the inner pressure sleeve 48 from formation of the chuck wall CW area of the shell being formed begins to heat up the tool so the excess heat developed by the inner pressure sleeve 48 is advantageously vented from bores 52, 54. Excess heat generation in the inner pressure sleeve 48 is not desirable in shell forming since the inner pressure sleeve 48 can undergo thermal expansion and cause the press to form shells that do not meet the tolerances required by a can maker. The invention solves the problem of excessive heat generation in the inner pressure sleeve that is experienced in other shell forming systems.

The punch 24 draws the material M over the die core ring 74 and begins to form the countersink CS of the shell between annular projection 34 and annular recess 76. The load applied to the material M begins to push the first elongated shaft 22 upward and the second elongated shaft 78 downward. A column of gas continues to support the first elongated shaft 22 and the second elongated shaft 78.

Figure 5:
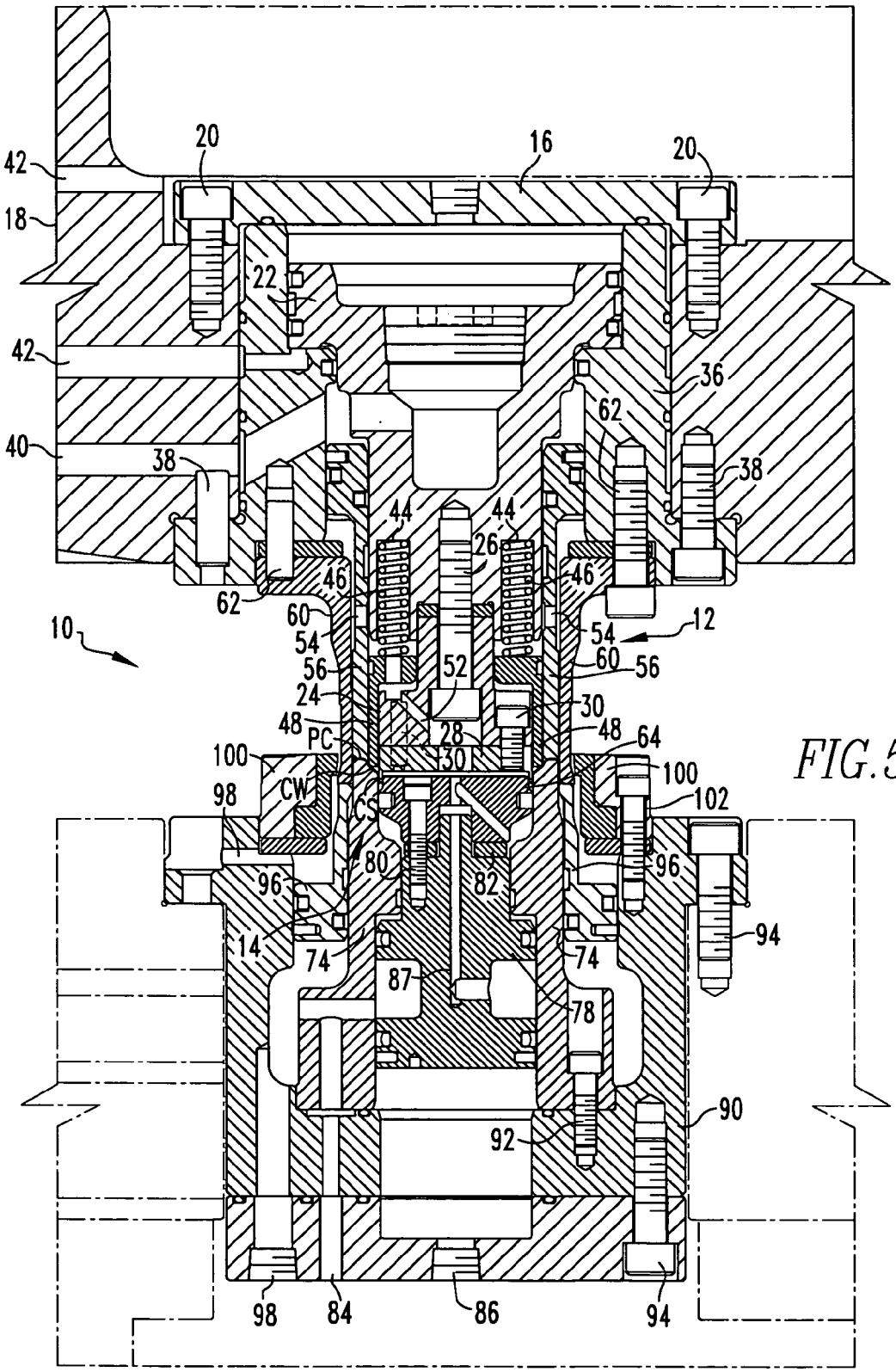
FIG. 5 is a cross-sectional view of a shell press assembly on the upstroke of the press.

In FIG. 5, the ram 18 begins its ascent away from the second die set 14 and the second elongated shaft 78 is selectively actuated upward to further form the shell. The punch shell 60 begins to move upward and the pressure pad 96 begins to move upward as well. A column of gas continues to support the pressure pad 96. As the ram 18 begins its ascent, the outer pressure sleeve 56 is allowed to move downward and continue to hold the material M between the outer pressure sleeve 56 and the die core ring 74. A column of gas continues to support the outer pressure sleeve 56. The inner pressure sleeve 48 continues to be selectively biased by biasing members 46 in FIG. 5, but not to the extent as is shown in FIG. 4. In effect, it appears as if the inner pressure sleeve 48 has moved downward from FIG. 4 to FIG. 5 as the ram 18 moves upward and away from the second die set 14. The selective biasing by biasing members 46 selectively controls movement of the inner pressure sleeve 48 upward and avoids excessive strain hardening of the chuck wall of the shell which is formed between the inner pressure sleeve 48 and the die core ring 74. Excess strain hardening of the chuck wall CW is not desirable in shell forming since the final converted can end could crack or deform once the can end is seamed onto a can body containing product that is under pressure. Also, any excess heat generated in the inner pressure sleeve 48 is advantageously vented from bores 52, 54. Excess heat generation in the inner pressure sleeve 48 is not desirable in shell forming since the inner pressure sleeve 48 can undergo thermal expansion and cause the press to form shells that do not meet the tolerances required by a can maker.

Movement of the second elongated shaft 78 upward rolls the material M upward to form the central panel CP of the shell between the punch core 24 and the die core 64. Rolling the material M upward also forms the countersink CS by the mating engagement of annular projection 34 with annular recess 76. The first elongated shaft 22 moves downward to its original position and a column of gas continues to support the first elongated shaft 22.

Figure 6:
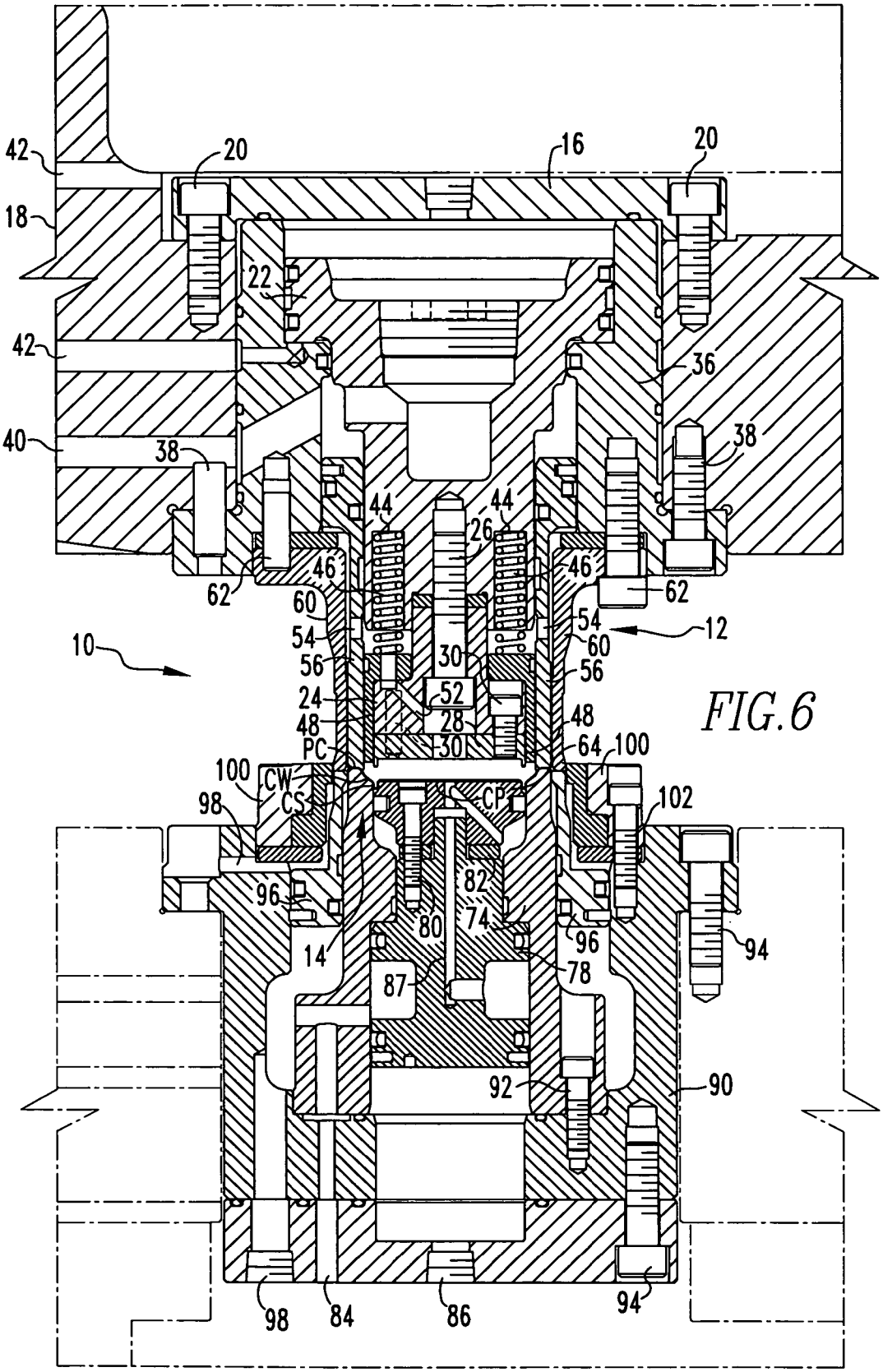
FIG. 6 is a cross-sectional view of a shell press assembly after the shell is formed and the inner pressure sleeve lifts off the shell.

In FIG. 6, the ram 18 continues its ascent away from the second die set 14 and the first elongated shaft 22, the punch core 24, the inner pressure sleeve 48, the outer pressure sleeve 56, the second elongated shaft 78 and the die core 64 have returned to their original positions. The punch shell 60 continues to lift off and the pressure pad 96 continues to move upward. The first elongated shaft 22, the outer pressure sleeve 56, the second elongated shaft 78 and the pressure pad 96 continue to be supported on a column of gas.

Figure 7:
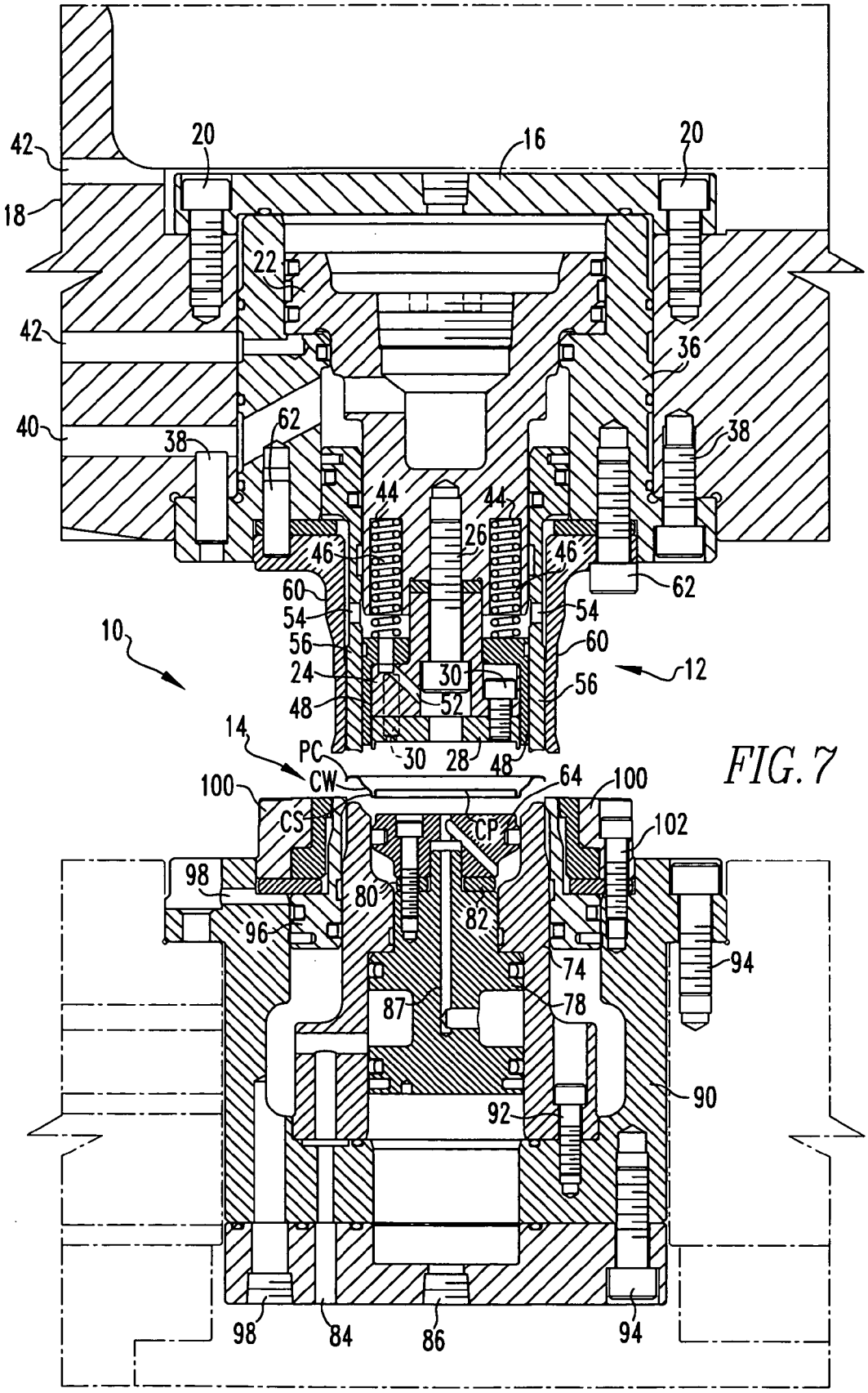
FIG. 7 is a cross-sectional view of a shell press assembly ejecting the shell from the press after the shell is formed.

In FIG. 7, the ram 18 has reached the top of the stroke and the shell press assembly 10 is in an open spaced apart relationship. Gas is supplied through bore 87 to eject the shell from the second die set 14. Alternatively, a lift out ring (not shown) could be used to eject the shell from the second die set 14. Now, the process of forming the shell with the shell press assembly 10 of the invention may be repeated.

Figure 8:
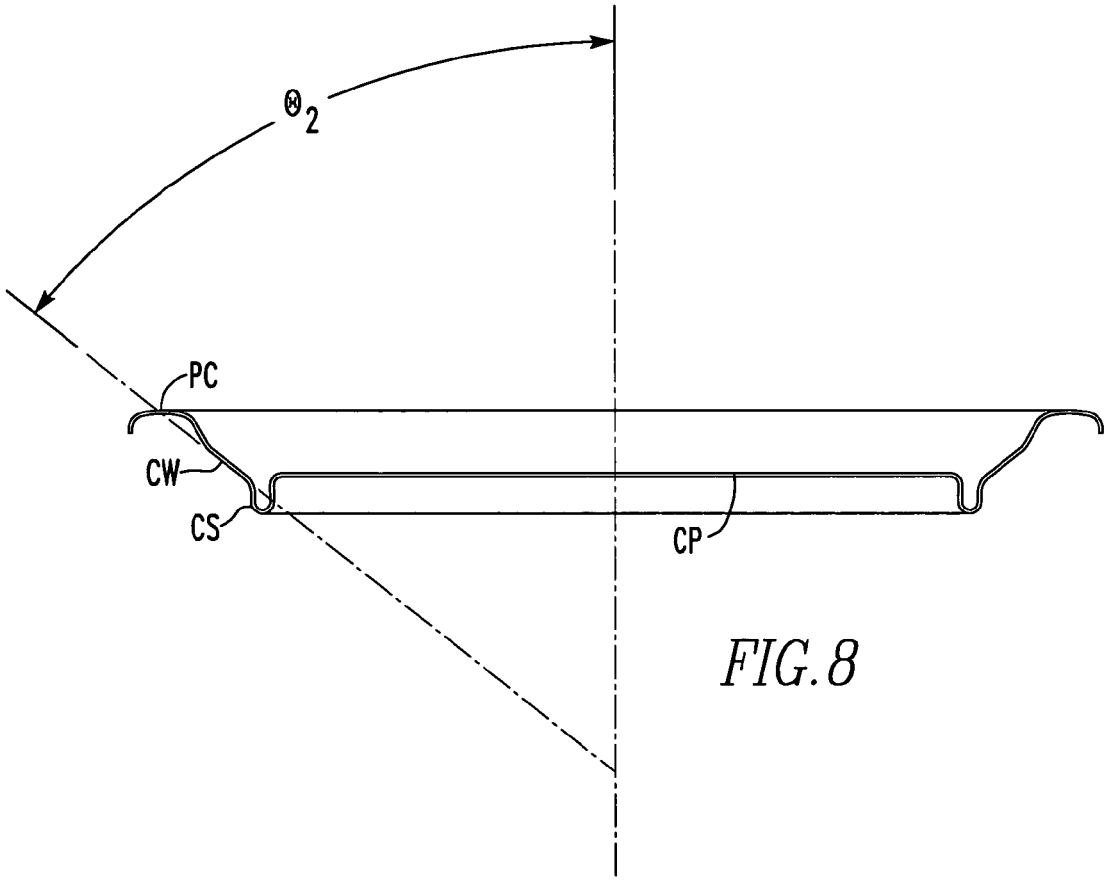
FIG. 8 is a cross-sectional view of a shell showing the angle, $\theta_2$ of the chuck wall of a shell.

If a line is drawn from one point on the lower portion of the chuck wall CW of the shell to a second point on the upper portion of the chuck wall CW of the shell, the angle, $\theta_2$ of the line relative to a vertical axis may be anywhere from approximately 20 degrees to approximately 60 degrees. See, FIG. 8. In alternate embodiments, a double action press (not shown) could be used with the invention disclosed in this patent application. For the purpose of simplifying the patent application, this apparatus and method has been omitted it being noted that the wear tools of FIGS. 1-7 and biasing members 46 would form the metal of the shell in a double action press with a substantially similar process to that depicted in FIGS. 1-7 described above. Additionally, an advantage of this invention is that the process of the invention can be used in a single action press or a double action press.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended hereto and any and all equivalents thereof.

What is claimed is:

1. An apparatus for forming a shell having a central panel and a chuck wall, the apparatus comprising:

a punch core;

an inner pressure sleeve located proximate to the punch core and radially outward from the punch core;

an outer pressure sleeve located proximate to the inner pressure sleeve and radially outward from the inner pressure sleeve;

a punch shell located proximate to the outer pressure sleeve and radially outward from the outer pressure sleeve;

a die core located in opposed relation to the punch core;

a die core ring located proximate to the die core and radially outward from the die core in opposed relation to the inner pressure sleeve and the outer pressure sleeve;

a pressure pad located proximate to the die core ring and radially outward from the die core ring in opposed relation to the punch shell;

a blank cutedge located proximate to the pressure pad and radially outward from the pressure pad; and a biasing member coupled to the inner pressure sleeve, wherein the biasing member is structured to selectively bias and control movement of the inner pressure sleeve.

2. The apparatus of claim 1, wherein the apparatus is a single action press or a double action press.

3. The apparatus of claim 1, wherein the punch core has a bore that is structured to remove heat from the inner pressure sleeve.

4. The apparatus of claim 1, wherein the biasing members are structured to control movement of the inner pressure sleeve and avoid excessive strain hardening of the chuck wall.

5. The apparatus of claim 1, further comprising an angle, $\theta_1$ formed between an axis and a line drawn from one point on the die core ring structured to form a lower portion of the chuck wall to a second point on the die core ring structured to form an upper portion of the chuck wall wherein the angle, $\theta_1$ is between approximately 20 degrees to approximately 60 degrees.

6. The apparatus of claim 1, further comprising an angle, $\theta_2$ formed between an axis and a line drawn from one point on a lower portion of the chuck wall to a second point on an upper portion of the chuck wall wherein the angle, $\theta_2$ is between approximately 20 degrees to approximately 60 degrees.

7. The apparatus of claim 1, wherein the die core has an outer diameter that is equal to or greater than an outer diameter of the punch core.

8. The apparatus of claim 7, wherein a portion of the die core is in contact with the die core ring.

9. The apparatus of claim 1, wherein the biasing member is located in a recess.

10. A method for forming a shell having a central panel and a chuck wall, the method comprising:

moving material between a first die set and a second die set;

blanking the material to form a blank;

forming the blank into a shell with the central panel and the chuck wall; and selectively controlling movement of an inner pressure sleeve by biasing the movement of the inner pressure sleeve with a biasing member.

11. The method of claim 10, wherein the method is performed in a single action press or a double action press.

12. The method of claim 10, further comprising removing heat from the inner pressure sleeve.

13. The method of claim 10, wherein the controlled movement of the inner pressure sleeve avoids excessive strain hardening of the chuck wall.

14. The method of claim 10, wherein the shell has an angle, $\theta_2$ formed between an axis and a line drawn from one point on a lower portion of the chuck wall to a second point on an upper portion of the chuck wall and the angle, $\theta_2$ is between approximately 20 degrees to approximately 60 degrees.

15. The method of claim 10, wherein the first die set includes a punch core with the inner pressure sleeve located proximate to the punch core, an outer pressure sleeve located proximate to the inner pressure sleeve and a punch shell located proximate to the outer pressure sleeve and the second die set includes a die core located in opposed relation to the punch core, a die core ring located proximate to the die core in opposed relation to the inner pressure sleeve and the outer pressure sleeve, a pressure pad located proximate to the die core ring in opposed relation to the punch shell and a blank cutedge located proximate to the pressure pad.

16. A method for forming a shell having a central panel and a chuck wall, the method comprising:

moving material between a first die set and a second die set, wherein the first die set includes a punch core, an inner pressure sleeve located radially outward to the punch core, an outer pressure sleeve located radially outward to the inner pressure sleeve and a punch shell located radially outward to the outer pressure sleeve and the second die set includes a die core located in opposed relation to the punch core, a die core ring located radially outward to the die core in opposed relation to the inner pressure sleeve and the outer pressure sleeve, a pressure pad located radially outward to the die core ring and a blank cutedge located radially outward to the pressure pad;

blanking the material with the punch shell against the blank cutedge to form a blank;

forming the blank into a shell with the central panel and the chuck wall from the material disposed between the punch core, the inner pressure sleeve, the outer pressure sleeve, the die core and the die core ring; and selectively controlling movement of the inner pressure sleeve by biasing the movement of the inner pressure sleeve with a biasing member.

17. The method of claim 16, wherein the method is performed in a single action press or a double action press.

18. The method of claim 16, further comprising removing heat from the inner pressure sleeve.

19. The method of claim 16, wherein the controlled movement of the inner pressure sleeve avoids excessive strain hardening of the chuck wall.

20. The method of claim 16, wherein the shell has an angle, $\theta_2$ formed between an axis and a line drawn from one point on a lower portion of the chuck wall to a second point on an upper portion of the chuck wall and the angle, $\theta_2$ is between approximately 20 degrees to approximately 60 degrees.

* * * * *